US008678851B2

(12) United States Patent
Yoshida et al.

(10) Patent No.: US 8,678,851 B2
(45) Date of Patent: Mar. 25, 2014

(54) CONTACT SECTION HAVING AN IRREGULAR SHAPE FORMED THEREON BY ELECTROFORMING

(75) Inventors: Hitoshi Yoshida, Otsu (JP); Hidekazu Yoshioka, Yawata (JP); Takaaki Suzumura, Ritto (JP); Jiro Koyama, Otsu (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 13/266,936

(22) PCT Filed: Mar. 24, 2011

(86) PCT No.: PCT/JP2011/057160
§ 371 (c)(1),
(2), (4) Date: Jan. 5, 2012

(87) PCT Pub. No.: WO2012/124167
PCT Pub. Date: Sep. 20, 2012

(65) Prior Publication Data
US 2013/0045617 A1 Feb. 21, 2013

(30) Foreign Application Priority Data
Mar. 15, 2011 (JP) ..... 2011-057073

(51) Int. Cl.
*H01R 4/24* (2006.01)

(52) U.S. Cl.
USPC ..... 439/398

(58) Field of Classification Search
USPC ..... 439/398–399, 345, 426
See application file for complete search history.

(56) References Cited

U.S. PATENT DOCUMENTS

| | | | | | |
|---|---|---|---|---|---|
| 4,026,013 | A * | 5/1977 | Hughes | 29/866 |
| 4,572,603 | A * | 2/1986 | Weidler | 439/426 |
| 4,579,413 | A * | 4/1986 | Weidler | 439/398 |
| 4,662,702 | A * | 5/1987 | Furuya | 439/630 |
| 5,112,233 | A | 5/1992 | Lybrand | |
| 5,624,273 | A * | 4/1997 | Myer | 439/399 |
| 2002/0055282 | A1 * | 5/2002 | Eldridge et al. | 439/66 |
| 2007/0269997 | A1 * | 11/2007 | Eldridge et al. | 439/66 |
| 2010/0081299 | A1 | 4/2010 | Hemmi et al. | |

FOREIGN PATENT DOCUMENTS

| | | |
|---|---|---|
| JP | 51-6694 | 2/1976 |
| JP | 54-64286 U | 5/1979 |
| JP | 55-95279 A | 7/1980 |
| JP | 2-47985 A | 2/1990 |

(Continued)

OTHER PUBLICATIONS

Office Action in Japanese patent Application No. 2011-057073, Dated Oct. 18, 2011 (8 Pages with English Translation).

(Continued)

*Primary Examiner* — Chandrika Prasad
(74) *Attorney, Agent, or Firm* — Osha Liang LLP

(57) ABSTRACT

A method for manufacturing a metal component includes the steps of forming a resist film on a surface of an electrode plate, making the resist film exposed to light by use of a photomask having a mask pattern, in at least part of a rim of which a fine concavity and convexity are drawn, developing the resist film, to form an opening for molding in the resist film, and depositing an electroforming material by electroforming inside the opening for molding, to mold the material.

6 Claims, 24 Drawing Sheets

(56) References Cited

FOREIGN PATENT DOCUMENTS

| | | | |
|---|---|---|---|
| JP | 4-8287 | A | 1/1992 |
| JP | 6-132047 | A | 5/1994 |
| JP | 1069929 | A | 3/1998 |
| JP | 2001-052827 | A | 2/2001 |
| JP | 2002-158056 | A | 5/2002 |
| JP | 2002-198115 | A | 7/2002 |
| JP | 2007-073296 | A | 3/2007 |
| JP | 2010-86878 | A | 4/2010 |

OTHER PUBLICATIONS

Korean Notice of Preliminary Rejection issued in Korean Application No. 10-2011-7024221, dated Oct. 11, 2012 and translation thereof (5 pages).
International Search Report from PCT/JP2011/057160 dated May 10, 2011 (2 pages).
Written Opinion from PCT/JP2011/057160 dated May 10, 2011 (5 pages).
Espacenet Abstract Publication JP54064286 dated May 7, 1979 (1 page).
Espacenet Abstract Publication JP55095279 dated Jul. 19, 1980 (1 page).
Espacenet Abstract Publication JP2047985 dated Feb. 16, 1990 (1 page).
Espacenet Abstract Publication JP4008287 dated Jan. 13, 1992 (1 page).
Espacenet Abstract Publication JP2002158056 dated May 31, 2002 (1 page).
Espacenet Abstract Publication JP2002198115 dated Jul. 12, 2002 (1 page).
Korean Intellectual Property Office Notice of Last Preliminary Rejection Issued in Korean Application No. 10-2011-7024221, Dated Apr. 3, 2013 (6 Pages).

* cited by examiner

CONTACT SECTION HAVING AN IRREGULAR SHAPE FORMED THEREON BY ELECTROFORMING

BACKGROUND

1. Technical Field

The present invention relates to a contact and a method for manufacturing a metal component. The present invention relates to a contact that is incorporated into a housing to form a connector, and a method for manufacturing a metal component usable for manufacturing the contact.

2. Background Art

Patent Document 1 discloses a connector with a configuration shown in FIGS. 1(A) and 1(B). Two kinds of contacts (contact terminals) are incorporated into a housing 12 of this connector 11. FIG. 2 shows one of contacts 21. In this contact 21, a fixing piece 22 and a movable piece 23 are almost in parallel, and the fixing piece 22 and the movable piece 23 are connected by a connecting section 24 vertical to both pieces 22, 23. A movable contact point section 25 is provided on the under surface of the front end of the movable piece 23, and the rear end of the movable piece 23 serves as an operation receiving section 26 that receives an action by a cam section 14 of the connector 11. Further, a slip-out preventive section 28 is projected from a position of the top surface, which is closer to the connecting section 24, of the fitting section 27 formed in the rear section of the fixing piece 22, and a leg section 29 for fixing is projected from the under surface of the front end of the fixing piece 22.

As shown in FIG. 1(A), the contact 21 is inserted from the front into an insertion hole 15 of the housing 12, and the rear surface of a leg section 29 for fixing hits on the front end of a base 12*a* of the housing 12 and then stops. The fitting section 27 is pressure-inserted into between the base 12*a* and a holding section 12*b* of the housing 12, and the slip-out preventive section 28 is fitted to the under surface of the holding section 12*b*, thereby to make the under surface of the fitting section 27 pressure-contacted to the base 12*a* so as to prevent the fitting section 27 from being slipped out. Further, a cam section 14 is inserted in between the operation receiving section 26 and the fitting section 27 of the contact 21. This cam section 14 is turnably operated by an operation lever 13.

Then, when a flexible print board 16 is to be connected to the connector 11, the flexible print board 16 is inserted into between the fixing piece 22 and the movable piece 23 in front of the connecting section 24, as shown in FIG. 1(B). Subsequently, the operation lever 13 is pulled down to turn the cam section 14, and the operation receiving section 26 is pushed up by the cam section 14. When the operation receiving section 26 is pushed up, the movable contact point section 25 falls to be pressure-contacted to the top surface of the flexible print board 16. The flexible print board 16 is bitten and held in such a warped state between the movable contact point section 25 and the fixing piece 22. Further, the movable contact point section 25 is pressure-contacted to an electrode pad of the flexible print board 16 so that the connector 11 is electrically connected with the flexible print board 16.

However, there are cases where the connector 11 receives vibrations depending on its application. Further, there are also cases where the contact 21 receives tensile force by the flexible print board 16 held therein. It is thus not possible to eliminate the fear of the contact 21 slipping out of the housing and being gradually loosened in the contact 11 as thus described.

Further, since this contact 21 is electrically connected with the flexible print board 16 only be making the movable contact point section 25 pressure-contacted to an electrode pad of the flexible print board 16, the electrical contact between the movable contact point section 25 and the electrode pad is required to be stabilized.

RELATED ART DOCUMENT

Patent Document

Patent Document 1: Japanese Unexamined Patent Publication No. 2010-86878

SUMMARY

One or more embodiments of the present invention provides a contact capable of reliably coming into electrical contact and mechanical contact with the other member. Further, one or more embodiments of the present invention provides a method for manufacturing metal components including the contact.

A contact according to one or more embodiments of the present invention is characterized in that an irregularity shape made up of at least either a depression or a protrusion is provided in a contact section with the other member.

In the contact according to one or more embodiments of the present invention, with the irregular shape provided in the contact section with the other member, it is possible to increase contact pressure with the other member. It is thereby possible to ensure electrical contact and mechanical contact. That is, providing the irregular shape in the contact section with the other member, such as the contact point section, can destruct a contamination and an oxide film on the electrode surface of the other member by the irregular shape and expose the electrode thereunder, so as to improve the reliability of electrical contact. Further, providing the irregular shape in the contact section with the other member, such as a pressure-contact section, leads to an increase in sliding resistance with the other member at the time of fitting the contact to the other member, so as to prevent the contact from being loosened or slipping out.

In the contact according to one or more embodiments of the present invention, the contact section with the other member is a contact point section, and the irregular shape extends in a vertical direction to a pressing direction and a wiping direction in the contact point section. In such an embodiment, the protrusion of the irregular shape is in linear contact with an electrode and the like of the other member, and is wiped in an orthogonal direction to the linearly contacted direction. Therefore, since the linearly contacted protrusion is moved in the orthogonal direction thereto to wipe the electrode surface in a planar form, it is possible to efficiently destruct a contamination and an oxide film on the surface of the electrode pad, so as to further improve the contact reliability of the contact point section.

In the contact according to one or more embodiments of the present invention, the contact section with the other member is a pressure-contact section to the other member, and the irregular shape extends in a vertical direction to an inserting direction into the other member. According to such an embodiment, since the inserting direction is orthogonal to the direction in which the irregular shape extends, the contact resists moving in the inserting direction so that the contact can be prevented from slipping out and being loosened.

In the contact according to one or more embodiments of the present invention, a width is not larger than 250 μm, and a tip of the protrusion constituting the irregular shape is curved.

According to such an embodiment, it is possible to make contact pressure of the irregular shape significantly high.

In the contact according to one or more embodiments of the present invention, a width is not larger than 250 μm, and the protrusion or the depression constituting the irregular shape is continued from one end to the other end in a width direction. According to such an embodiment, with the protrusion and the depression continued from the end to the end, the contact with the other member is stabilized and the contact thus resists tilting.

In the contact according to one or more embodiments of the present invention, the irregular shape is provided at the time of production by electroforming. According to such an embodiment, a clear irregular shape can be created as compared with the case of producing the contact by punching.

A first manufacturing method for a metal component according to one or more embodiments of the present invention has the steps of: forming a resist film on the surface of an electrode plate; making the resist film exposed to light by use of a photomask having a mask pattern, in at least part of the rim of which a fine concavity and convexity are drawn; developing the resist film, to form an opening for molding in the resist film; and depositing an electroforming material by electroforming inside the opening for molding, to mold the material. The term "rim" here may refer to a rim on the inner peripheral side or a rim on the outer peripheral side. According to the first manufacturing method of one or more embodiments of the present invention, the irregular shape can be created on the surface of the metal component by means of the irregularity of the mask pattern which is formed in the photomask. Further, designing an arbitrary shape in the photomask can form a desired irregular pattern in the metal component.

A second manufacturing method for a metal component according to one or more embodiments of the present invention has the steps of: forming a resist film on the surface of an electrode plate; making the resist film exposed to light in a state where a microparticle group is distributed between the resist film and the photomask; developing the resist film, to form an opening for molding in the resist film; and depositing an electroforming material by electroforming inside the opening for molding, to mold the material. According to the second manufacturing method of one or more embodiments of the present invention, it is possible to create the irregular shape in the metal component without using a high-priced photomask, so as to make the manufacturing cost of the metal component low.

A third manufacturing method for a metal component according to one or more embodiments of the present invention has the steps of: arranging a dry film resist, having a microparticle layer in a surface layer section, on the surface of an electrode plate; making the resist film exposed to light and developed, to form an opening for molding in the resist film; and depositing an electroforming material by electroforming inside the opening for molding, to mold the material. As the microparticle layer on the surface layer section of the dry film, a protective film with a lubricant can be used which is pasted to the surface of the dry film resist for preventing intimate contact in a manufacturing process and a distribution process for the dry film. According to a third manufacturing method of one or more embodiments of the present invention, it is possible to create the irregular shape in the metal component without using a high-priced photomask, and further to make use of the protective film of the dry film resist, so as to make the manufacturing cost of the metal component low.

A metal component, especially a contact, according to one or more embodiments of the present invention is one having the surface provided with an irregular shape made up of at least either a depression or a protrusion by the first to third manufacturing methods. In such a metal component or a contact, a fine irregular shape can be given in a simple manner to the surface of the metal component manufactured by electroforming.

A connector according to one or more embodiments of the present invention is characterized in that the contact according to one or more embodiments of the present invention is housed in a housing. According to such a connector, the contact can be well incorporated into the housing so that the contact resists slipping out from the housing. Further, the reliability of electrical contact with an electrode pad of a flexible print board or the like is improved.

It is noted that embodiments of the present invention have features in appropriate combination of the above described constitutional elements, and a large number of variations by combination of such constitutional elements is possible.

BRIEF DESCRIPTION OF THE DRAWINGS

FIG. 25(A) is a sectional view of a state before the connection, and FIG. 25(B) is a sectional view of a state after the connection.

DETAILED DESCRIPTION

Hereinafter, embodiments of the present invention will be described with reference to the attached drawings. However, the following embodiments of the present invention are not restrictive, and a variety of changes in design can be made within the range not deviating from the gist of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

(Structure of Contact)

Figure 3:
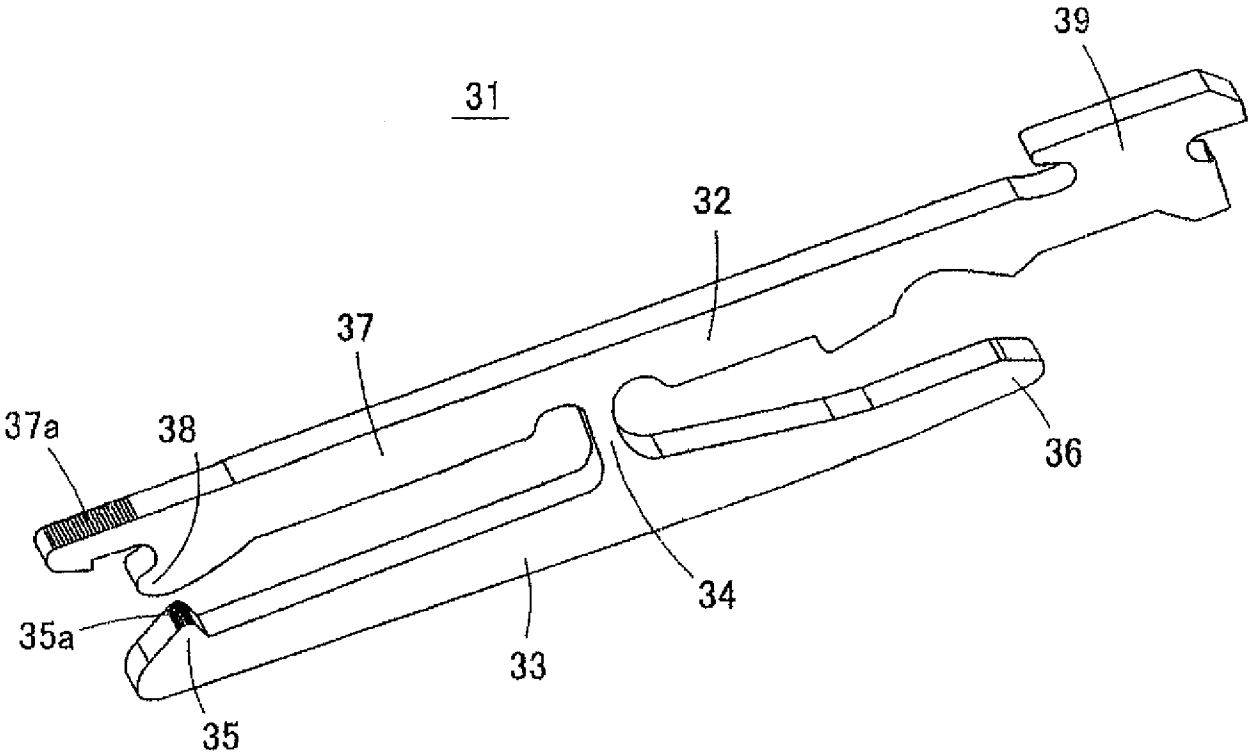
FIG. 3 is a perspective view of a vertically inverted state of a contact according to an embodiment of the present invention.
Figure 4:
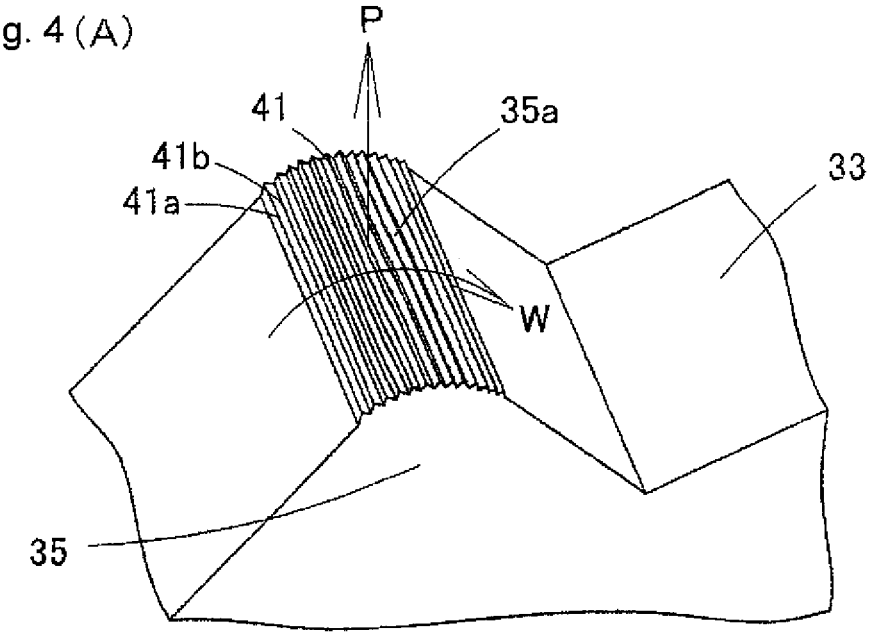
FIG. 4(A) is an enlarged perspective view showing a contact point section of the contact shown in FIG. 3.
FIG. 4(B) is an enlarged perspective view showing a fitting section of the contact shown in FIG. 3.
Figure 4:
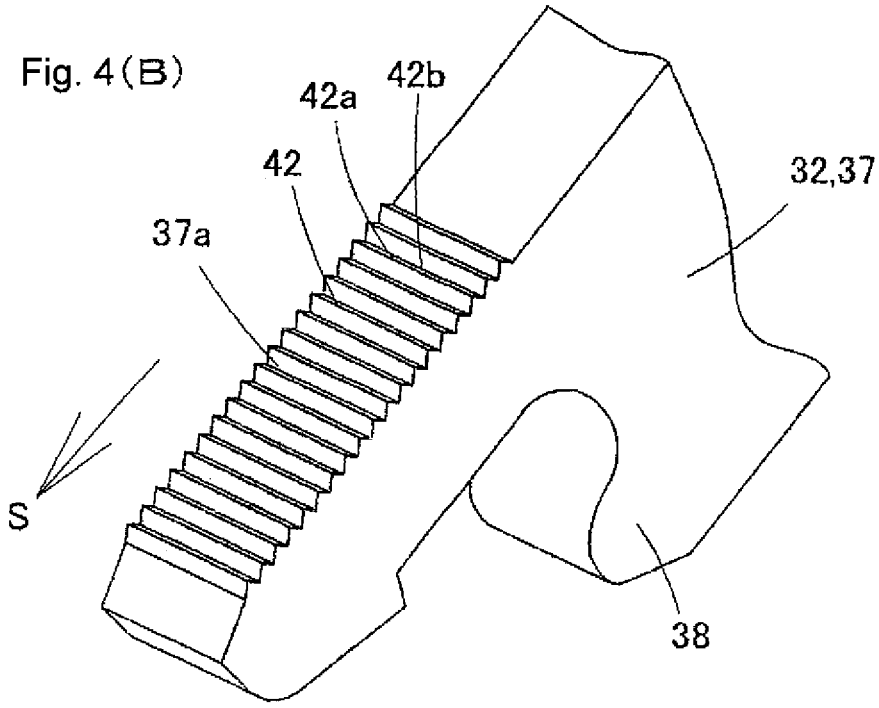
Figure 5:
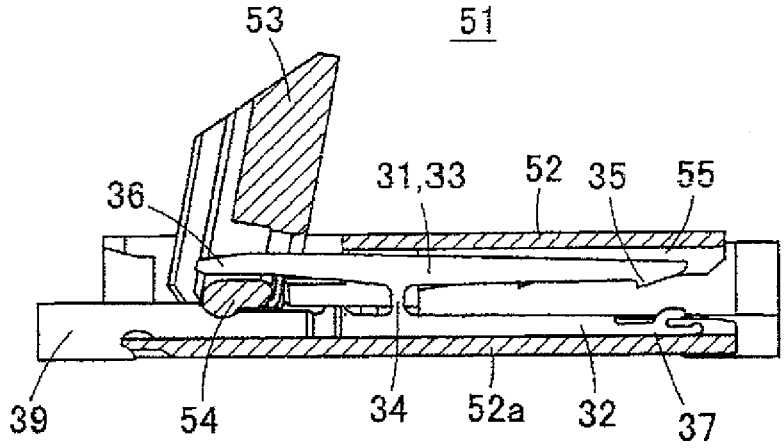
FIG. 5(A) is a sectional view of a connector using the contact of FIG. 3.
FIG. 5(B) is a sectional view showing the state of connecting a flexible print board to the connector.
Figure 5:
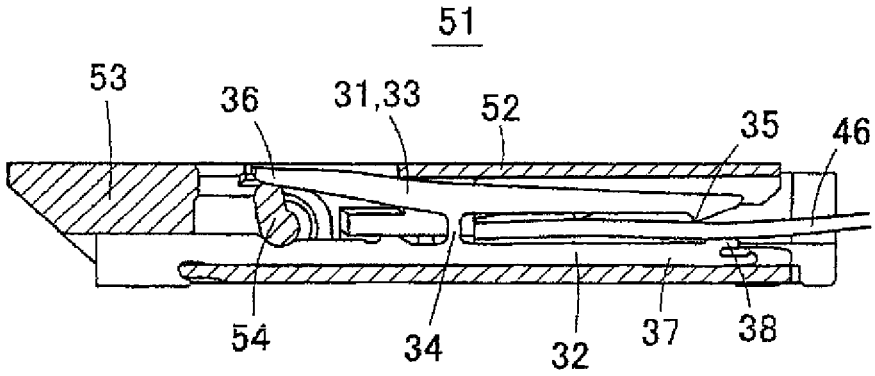

FIG. 3 is a perspective view of a contact 31 according to an embodiment of the present invention, which is represented in a vertically inverted state. This contact 31 is a minute contact terminal produced by electroforming. FIGS. 4(A) and 4(B) are expanded views of part of the contact 31. Further, FIG. 5(A) is a sectional view of a connector 51 incorporated with the contact 31, and FIG. 5(B) is a sectional view of the connector 51 connected with a flexible print board 46.

In the contact 31, a fixing piece 32 and a movable piece 33 are almost in parallel, and the fixing piece 32 and the movable piece 33 are integrally connected by a connecting section 34 almost vertical to both pieces 32, 33. A movable contact point section 35 in a triangle shape is projected from the under surface of the front end of the movable piece 33, and the rear end of the movable piece 33 serves as an operation receiving section 36 that receives an action by a cam section of the connector 51. Further, the front end of the fixing piece 32 serves as a fitting section 37 that is fitted with a housing 52 at the time of the contact 31 being housed into an insertion hole of the housing. Moreover, a projected section 38 is projected from the top surface of the fitting section 37. A leg section 39 for fixing is projected from the under surface of the rear end of the fixing piece 32.

On a contact surface of the movable contact point section 35 which is pressure-contacted to an electrode pad of the flexible print board, namely a contact-point contact surface 35*a* located on the under surface of the movable contact point section 35, as shown in FIG. 4(A), an irregular shape 41 is formed which is made up of a plurality of protrusions 41*a* or depressions 41*b* extending along a vertical direction to a pressing direction P and a wiping direction W of the movable contact point section 35. This irregular shape 41 is typically made up of a plurality of protrusions or depressions continuously extending from one end to the other end along a width direction of the contact 31.

Further, on the surface of the fitting section 37 which comes into contact with the housing, namely a pressure-contact surface 37*a* located on the under surface of the fitting section 37, an irregular shape 42 is formed which is made up of a plurality of protrusions 42*a* or depressions 42*b* extending in a vertical direction to a pressure-inserting direction S of the fitting section 37, as shown in FIG. 4(B). This irregular shape 42 is also typically made up of a plurality of protrusions or depressions continuously extending from one end to the other end along a width direction of the contact 31. It is to be noted that the irregular shape is not one forming the shape of the contact, but one with a minute size even compared with a minute contact.

(Structure of Connector)

Figure 1:
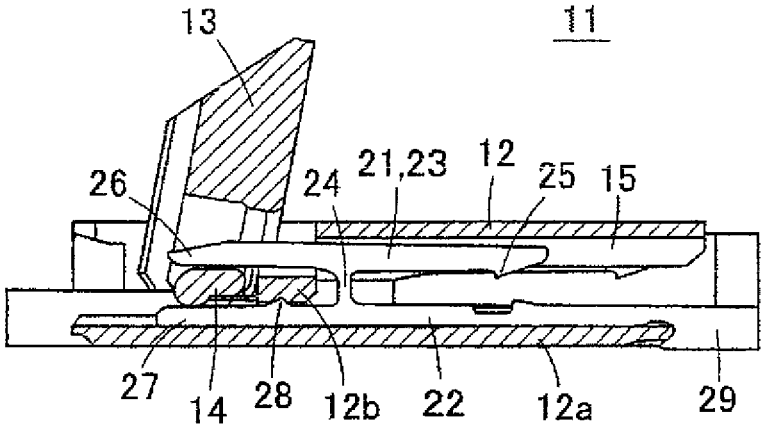
FIGS. 1(A) and 1(B) are sectional views showing a conventional connector.
Figure 1:
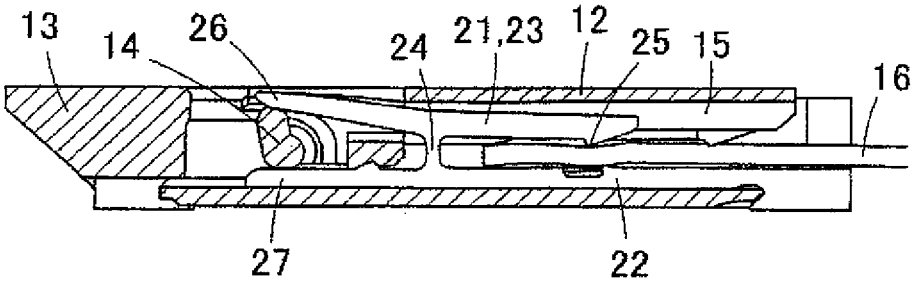
Figure 2:
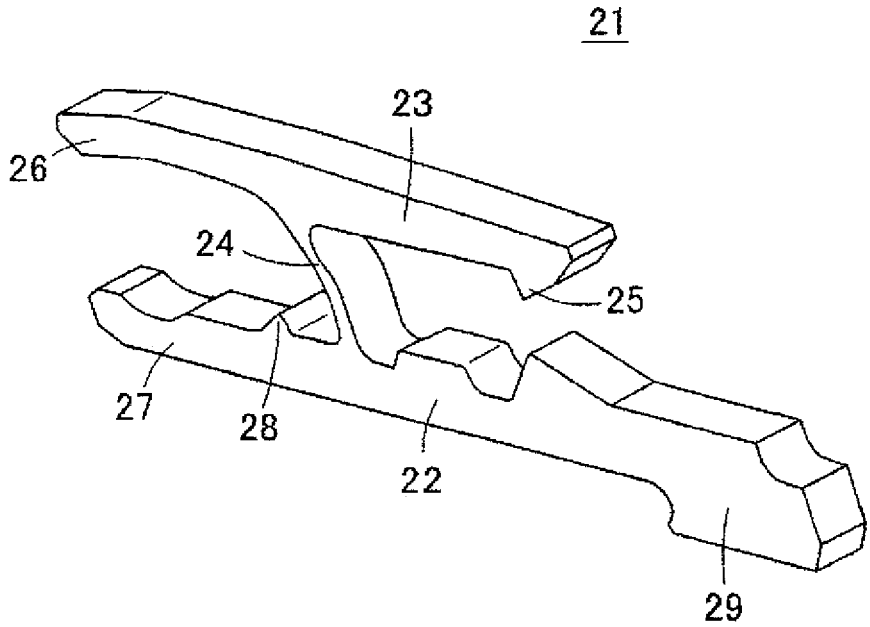
FIG. 2 is a perspective view of a contact used in the connector of FIG. 1.

The connector 51 shown in FIGS. 5(A) and 5(B) is one incorporated with the contact 31. A plurality each of two kinds of contacts are incorporated in this connector. One contact is the contact 31. The other contact is one obtained such that in the contact 21 shown in FIG. 1, the irregular shape 41 is provided on the contact-point contact surface of the movable contact section 25 and the irregular shape 42 is provided on the pressure-contact surface of the fitting section 27, as in the contact 31 of FIG. 3.

The connector 51 may be almost similar to the connector disclosed in Patent Document 1 except that the irregular shapes 41, 42 are provided in both contacts. Therefore, the connector 51 is simply described with reference to FIGS. 5(A) and 5(B). (As for those respects not described here, descriptions of Patent Document 1 may be cited.)

As shown in FIG. 5(A), the contact 31 is inserted from the rear into an insertion hole 55 of the housing 52, and the front surface of the leg section 39 for fixing hits on the rear end of a base 52*a* of the housing 52, and then stops. The fitting section 37 is pressure-inserted into the housing 52, and a pressure-contact surface 37*a* (irregular shape 42) provided on the under surface of the fitting section 37 is pressure-contacted to the top surface of the base 52*a*, to prevent the contact 31 from slipping out. Further, a cam section 54 is inserted in between the operation receiving section 36 and the fixing piece 32 of the contact 31. This cam section 54 is turnably operated by an operation lever 53.

Then, when a flexible print board 46 is to be connected to the connector 51, the flexible print board 46 is inserted into between the fixing piece 22 and the movable piece 23 in front of the connecting section 24, as shown in FIG. 5(B). Subsequently, the operation lever 53 is pulled down to turn the cam section 54, and the operation receiving section 36 is pushed up by the cam section 54. When the flexible print board 36 is pushed up, the movable contact point section 35 falls to be pressure-contacted to the top surface of the flexible print board 46. The flexible print board 46 is bitten and held between the movable contact point section 35 and the projected section 38 in such a warped state. Further, the movable contact point section 35 is pressure-contacted to an electrode pad of the flexible print board 46, so that the connector 51 is electrically connected with the flexible print board 46.

Figure 6:
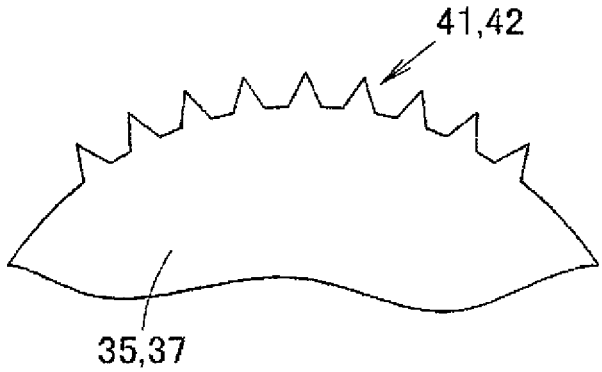
FIGS. 6(A) and 6(B) are sectional views showing a variety of surfaces each provided with an irregular shape in FIGS. 6(A), 6(B) and 6(C).
Figure 6:
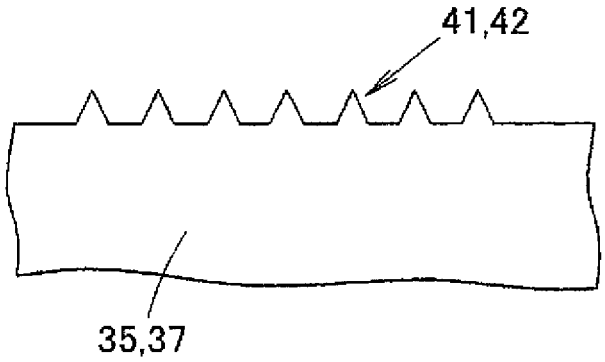
Figure 6:
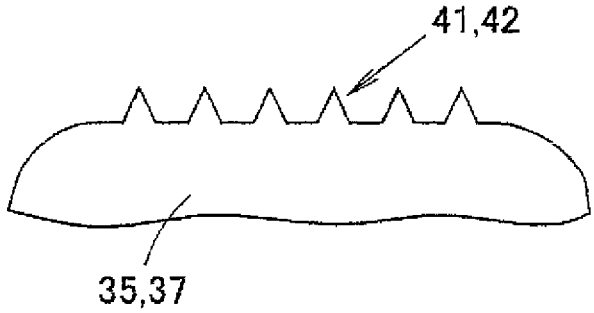

It is to be noted that each of the position of the contact-point contact surface 35*a* (irregular shape 41) and the position of the pressure contact surface 37*a* (irregular shape 42), shown in FIG. 3, is one example, and changed as appropriate. That is, since the positions of the movable contact point section 35 and the contact-point contact surface 35*a* change depending on the structure or the kind of the connector incorporated with the contact 31, or the like, the position of the irregular shape 41 changes accordingly. Further, since the position of the pressure contact surface 37*a* of the contact 31 also changes depending on the shape of the housing or the way to incorporate the contact 31 into the housing, the position of the irregular shape 42 also changes accordingly. Therefore, the irregular shapes 41, 42 may be provided on a curved surface as in FIG. 6(A), may be provided on a flat surface as in FIG. 6(B), or may be provided on a swelled flat surface as in FIG. 6(C).

Further, the contact 31 is one also usable for a terminal of a relay or a switch, or the like, other than the connector.

(Action Effect of Contact)

Figure 7:
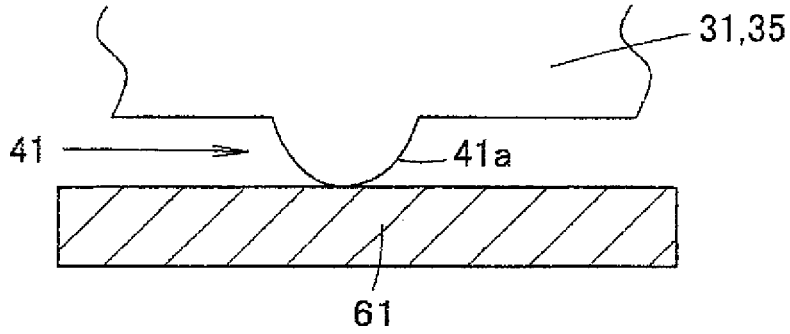
FIGS. 7(A), 7(B) and 7(C) are explanatory views of an action of the contact shown in FIG. 3.
Figure 7:
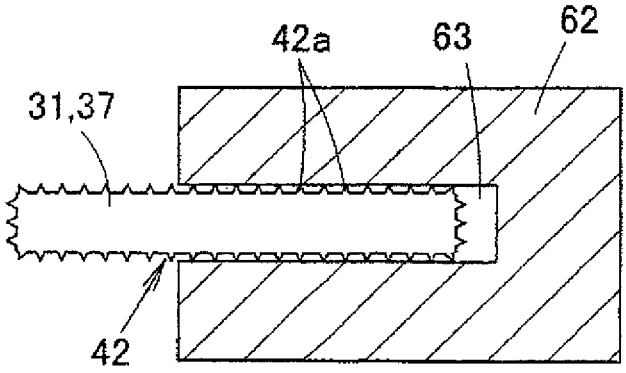
Figure 7:
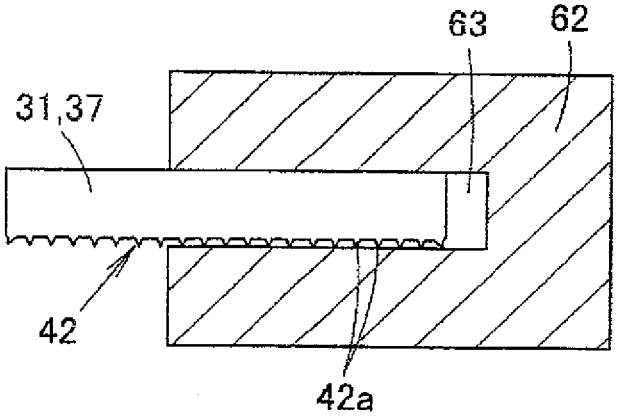

Next, an effect of providing the irregular shapes 41, 42 in the contact 31 will be described. In this contact 31, with the irregular shape 41 formed on the contact surface of the movable contact point section 35, contact pressure of the movable contact point section 35 is concentrated on the tips of the protrusions 41*a*, and the contact pressure of the movable contact point section 35 thus increases, to improve the contact reliability of the movable contact point section 35. Further, when the irregular shape 41 is provided in the movable contact point section 35, a contamination and an oxide film, having occurred on the surface of the electrode pad of the flexible print board 46, can be destroyed by the protrusions 41*a*, to bring the movable contact point section 35 into contact with the metal surface of the exposed electrode pad, so as to improve the contact reliability of the movable contact point section 35. In particular, as shown in FIG. 7(A), in the case of the irregular shape 41 extending in the vertical direction to the pressing direction P and the wiping direction W of the movable contact point section 35, the protrusions 41*a* come into linear contact with an electrode pad 61, and are wiped in an orthogonal direction to the linearly contacted direction. Therefore, since the linearly contacted protrusions 41*a* are moved in the orthogonal direction thereto to wipe the surface of the electrode pad, it is possible to efficiently destruct a contamination or an oxide film on the surface of the electrode pad, so as to further improve the contact reliability of the contact point section 35.

Moreover, in this contact 31, the irregular shape 42 extending in an orthogonal direction to the inserting direction of the contact 31 is provided on the pressure contact surface 37*a* which is in contact with the housing 52, and it is thus possible to make small the contact surface between the pressure contact surface 37*a* and the housing 52. It is therefore possible to increase contact pressure of the pressure contact surface 37*a* (or the irregular shape 42). As a result, for example as shown in FIG. 7(B), when the contact 31 is pressure-inserted into an insertion hole 63 of a partner member 62, sliding resistance between the contact 31 and the housing 52 can be increased to enhance the retentivity of the contact 31, thereby making the contact 31 resist loosening and slipping out from the housing 52. Especially, loosening of the contact 31 due to vibrations or tensile force from the substrate 46 can be reduced. In order to obtain this effect, it is not necessary to provide the irregular shape 42 on the whole surface of the fitting section 37 as shown in FIG. 7(B), and the irregular shape 42 may be formed in part of the fitting section 37 as shown in FIG. 7(C).

(About Irregular Shape)

Figure 8:
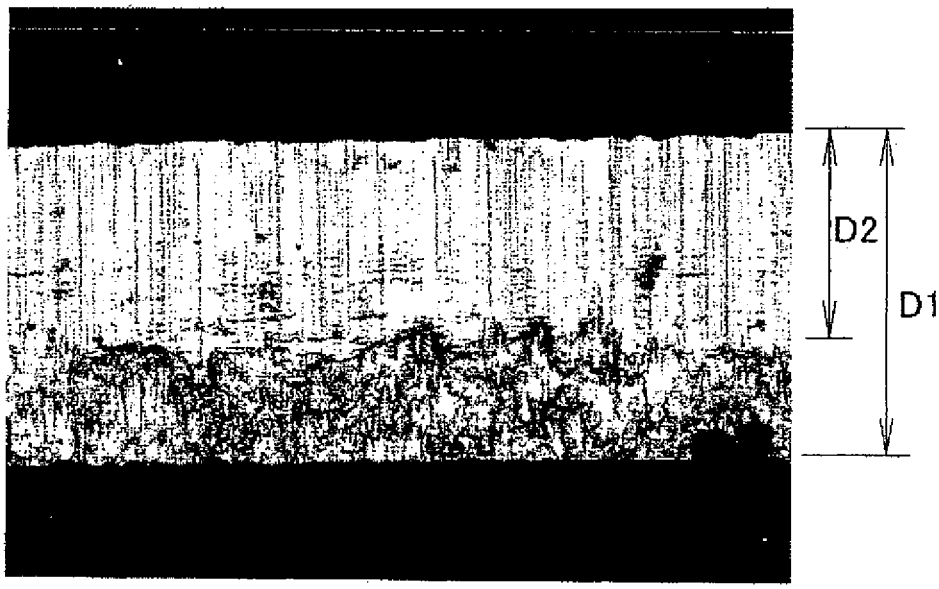
FIG. 8 shows a section of a metal component punched out by a press.

Next, a favorable irregular shape will be described. Generally, the contact is often produced by punching out a metal plate. FIG. 8 shows a micrograph of a cross section at the time of punching out the metal plate by a press. In the cross section at the time of punching out the metal plate by the press, a streaky shearing surface and a fracture surface where its texture is as if fractured are represented, and the streaks of the shearing surface are interrupted by the fracture surface. Herein, when a thickness of the metal plate is denoted by D1 and a length (thickness) of the shearing surface is denoted by D2, a value of D2/D1 is generally not smaller than ½ and not larger than ⅓. In the case of using such a cross section formed by the press as the contact surface of the contact, the contact comes into partial contact with the partner member at the time of contact therewith and is then tilted. Further, the contact with the partner member also becomes unstable. For this reason, the cross section formed by the press is not preferred as the contact surface of the contact.

According to one or more embodiments of the present invention, a width of the contact is not larger than 250 μm, and according to one or more embodiments of the present invention, an irregular shape is continued from one end (one side surface) to the other end (the other side surface) in the width direction and has an arc-shaped surface or a semicircular cross section. The reason for this will be described hereinafter.

Figure 9:
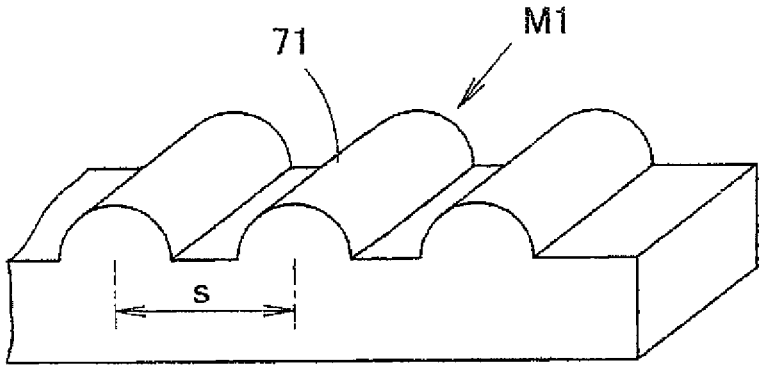
FIG. 9(A) is a perspective view representing an irregular pattern continuously extended from the end to the end along a width direction and made up of protrusions each having an arc-shaped cross section.
FIG. 9(B) is a perspective view representing a contact surface where V-groove-shaped depressions 72 (or protrusions having a trapezoidal cross section) are arrayed at an average pitch s, and a surface 73 is flat at one end.
FIG. 9(C) is a case where a speed-before-quality surface is flat.
Figure 9:
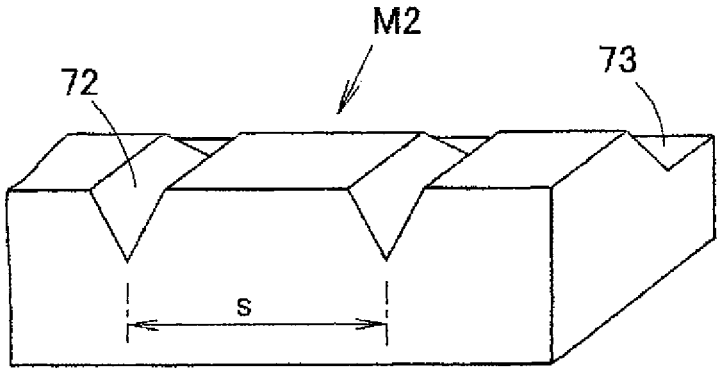
Figure 9:
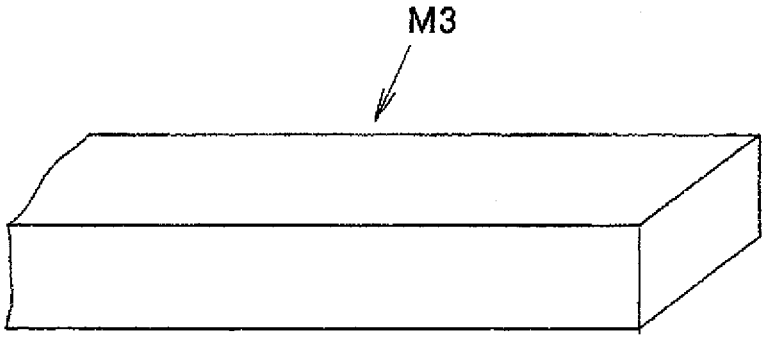

First, as shown in FIG. 9(A), there was considered a contact surface having an irregular shape where the protrusions 71 having an arc-shaped surface (semicircular cross section) extend from the end to the end, and are arrayed at an average pitch s. This is referred to as a model M1. First, as shown in FIG. 9(B), there was considered a contact surface where V-groove-shaped depressions 72 (or protrusions having a trapezoidal cross section) are arrayed at an average pitch s, and a surface 73 is flat at one end. This is referred to as a model M2. The model M2 is one obtained by modeling the cross section formed by the press as in FIG. 8. Further, FIG. 9(C) is a case where a speed-before-quality surface is flat. This is referred to as a model M3.

Subsequently, contact pressure of each of these models M1 to M3 was calculated. In the model M1 having the arc-shaped irregular shape as in FIG. 9(A), the contact pressure is large due to linear contact, and the contact pressure was thus calculated using the Hertz theory (e.g., "NACHI-BUSINESS news, vol. 1001, June 2006, published by Development and Planning Division, Development Group of NACHI-FUJIKOSHI CORP.). When the number of arc-shaped protrusions is one, surface pressure at the time of contact between the protrusion (cylinder) and the plan surface is expressed by Mathematical Formula 1 below:

[Mathematical Formula 1]

$$Pm = 0.418 \times \sqrt{E} \times \sqrt{\frac{F}{t} \times \frac{1}{R}} \quad \text{(Mathematical Formula 1)}$$

where

Pm is a contact pressure,

F is a load (pressurized force),

E is a Young's modulus, t is a plate thickness, and

R is a curvature radius of the protrusion surface.

However, since the plurality of arc-shaped protrusions are considered in the model M1, Mathematical Formula 1 above is corrected to be as Mathematical Formula 2 below:

[Mathematical Formula 2]

$$Pm = 0.418 \times \sqrt{E} \times \sqrt{\frac{f}{t} \times \frac{1}{R}} = 0.418 \times \sqrt{E} \times \sqrt{\frac{s}{L} \times \frac{F}{t} \times \frac{1}{R}} \quad \text{(Mathematical Formula 2)}$$

where

Pm is a contact pressure,

F is a load,

E is a Young's modulus, t is a plate thickness,

R is a curvature radius of the protrusion surface, f is a force applied per one protrusion, n is the number of protrusions, L is a contact width, s is an average pitch of the irregularity, and f=F/n, L=n×s.

Next, in the model M2 having trapezoidal protrusions as in FIG. 9(B), the contact is a plane contact, and hence the calculation was performed simply by a surface area. In the model M2, an area ratio of the V-groove was set to 10% at the maximum, and a ratio D2/D1 of the shearing surface was set to 30%. A calculating formula used is Mathematical Formula 3 below:

[Mathematical Formula 3]

$$Pm = \frac{1}{30\%} \times \frac{1}{90\%} \times \frac{F}{L \times t} = 3.7 \times \frac{F}{L \times t} \quad \text{(Mathematical Formula 3)}$$

where pm is a contact pressure,

F is a load, t is a plate thickness, and

L is a contact width.

Next, in the model M3 being flat as in FIG. 9(C), the calculation was performed by Mathematical Formula 3 below. This corresponds to a case where an area ratio of the V-groove is set to 0%, and a ratio of the shearing surface is set to 100% in the model M2.

[Mathematical Formula 4]

$$Pm = \frac{F}{L \times t} \quad \text{(Mathematical Formula 4)}$$

where pm is a contact pressure,

F is a load, t is a plate thickness, and

L is a contact width.

Respective contact pressures P of the models M1 to M3 were calculated using Mathematical Formulas 2 to 4 above. In performing the calculation, each condition was uniformed. A condition 1 is as follows:

the average pitch s of irregularity is 0.1 mm;

the load (pressurized force) F is 100 gf;

the contact width L is 0.05 mm;

the plate thickness t is 0.1 mm; and the curvature radius R is 0.002 mm.

As for the Young's modulus and a Poisson ratio, values of "phosphor bronze" most heavily used as a connector material were used.

Young's modulus $E=1.2\times10^5$ [N/mm$^2$]

Poisson ratio=0.3

This condition 1 is a condition assuming large contact force. This resulted as shown in Table 1 below:

TABLE 1

| Model | Calculated value [N/mm$^2$] | Ratio |
|---|---|---|
| M1 (arc shape) | 45000 | 231.3 |
| M2 (v-groove) | 725 | 3.7 |
| M3 (flat surface) | 196 | 1 |

Further, a condition 2 assuming small contact force is as follows:

the average pitch s of irregularity is 0.004 mm;

the load (pressurized force) F is 10 gf;

the contact width L is 10 mm;

the plate thickness t is 0.25 mm; and the curvature radius R is 0.025 mm.

As for the Young's modulus and a Poisson ratio, the above values of "phosphor bronze" most heavily used as the connector material were also used herein. This resulted as shown in Table 2 below:

TABLE 2

| Model | Calculated value [N/mm$^2$] | Ratio |
|---|---|---|
| M1 (arc shape) | 36.3 | 925.1 |
| M2 (v-groove) | 0.1 | 3.7 |
| M3 (flat surface) | 0.04 | 1 |

As seen from the results of Tables 1 and 2 above, in either the case of small contact pressure or the case of large contact pressure (thus even medium contact pressure therebetween), the model M1 having the arc-shaped protrusions generates very large contact pressure as compared with the other models.

Also in another calculation, in a case where the contact pressure of the model M3 is set to 1, the contact pressure of the model M2 formed with v-grooves at a pitch of s=8 μm was 3.7 times as large as that of the model M3. Further, the contact pressure of the model M1 provided with arc-shaped protrusions having a radius of 0.3 μm an at a pitch of s=4.1 μm was 182 times as large as that of the model M3, and the contact pressure of the model M1 provided with the arc-shaped protrusions having a radius of 4 μm at a pitch of s=8 μm was 71 times as large as that of the model M3. According to the Hertz formula, a contact pressure of the irregular shape made up of the arc-shaped protrusions is larger than a contact pressure of a component formed by a press.

(First Manufacturing Method for Metal Component)

Figure 10A:
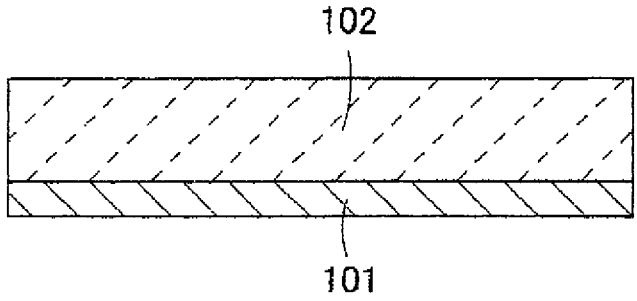
FIGS. 10(A) to 10(C) are schematic views showing a first manufacturing method for manufacturing a metal component having an irregular shape having an arc-shaped cross section.
Figure 10B:
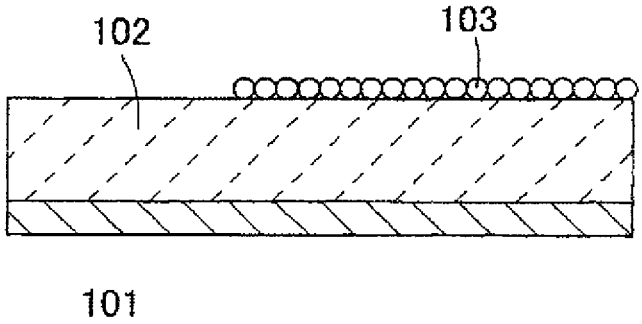
Figure 10C:
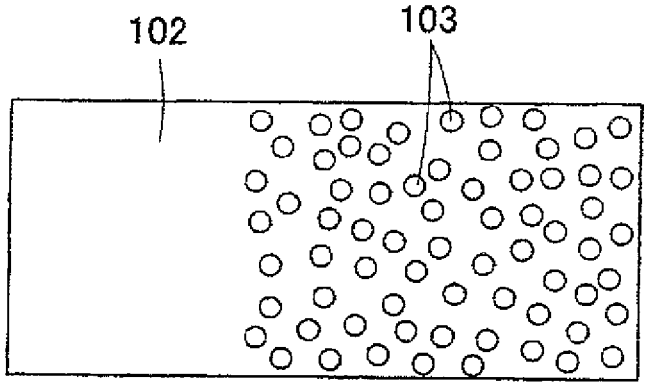
Figure 11:
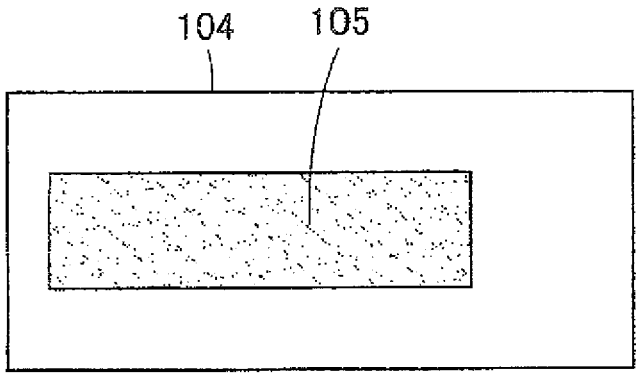
FIGS. 11(A) to 11(C) are schematic views showing the first manufacturing method for manufacturing the metal component having the irregular shape with an arc-shaped cross section, continued from FIG. 10(C).
Figure 11:
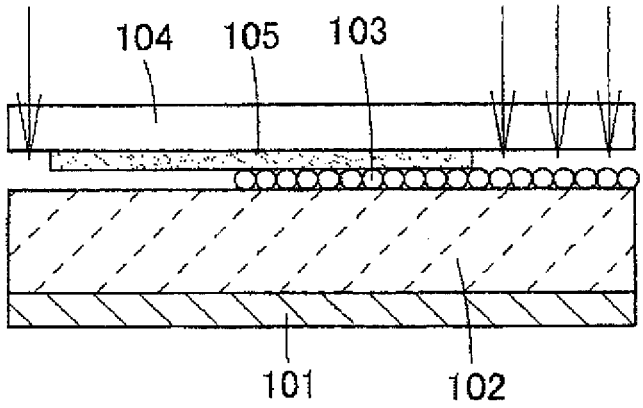
Figure 11:
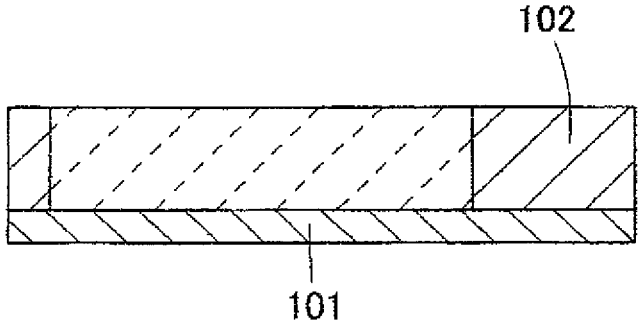
Figure 12A:
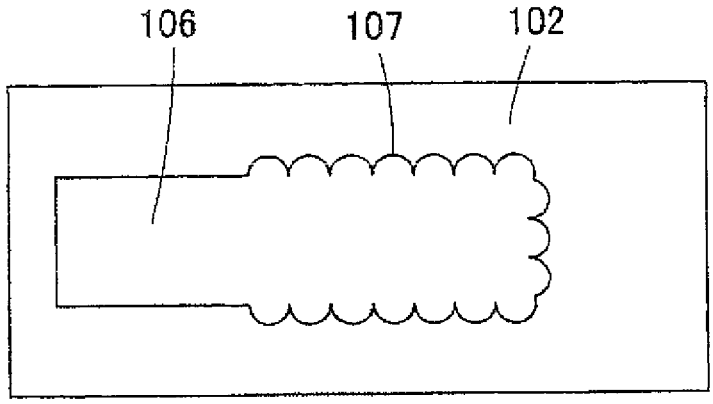
FIGS. 12(A) to 12(D) are schematic views showing a first manufacturing method for manufacturing the metal component having the irregular shape with an arc-shaped cross section, continued from FIG. 11(C).

As thus described, according to one or more embodiments of the present invention, the irregular shape of the contact has protrusions having an arc-shaped cross section continuously formed from the end to the end with respect to the metal plate with a width of not larger than 25 μm. The contact having such an irregular shape, which is expressed in a general term as a metal plate, can be produced by electroforming in such a manner as below:

A first manufacturing method for a metal component by electroforming is shown in FIGS. 10(A) to 10(C), FIGS. 11(A) to 11(C) and FIGS. 12(A) to 12(D). Herein, FIGS. 10(A), 10(B), 11(B), 11(C) 12(B) and 12(C) are sectional views. FIG. 10(C) is a plan view of FIG. 10(B). FIG. 11(A) is a bottom view of a photomask shown in FIG. 11(B). FIG. 12(A) is a plan view of FIG. 12(B). FIG. 12(D) is a perspective view of the metal plate.

In the first manufacturing method, first, as shown in FIG. 10(A), a negative type resist is applied to the top surface of an electrode plate 101 for electroforming, to form a resist film 102. The electrode plate 101 is a substrate having conductivity, and one obtained by coating a conductive material on a metal plate, the surface of a plate made of a conductive material or a plate made of a non-conductive material. Subsequently, as shown in FIGS. 10(B) and 10(C), microparticles 103 are distributed on the top surface of the resist film 102 at an appropriate density, to form a microparticle layer. An area to be distributed with the microparticles 103 may be the whole or part of the top surface of the resist film 102. Further, the microparticle may be one that shields light such as a metal microparticle or a ceramic microparticle, or may be a transparent body that scatters light such as a glass particle. The microparticle layer may be formed by pasting a transparent sheet containing microparticles to the top surface of the resist film 102, applying microparticles dispersed in a resist solution to the top surface of the resist film 102, or spraying powder microparticles (powders) to the top surface of the resist film 102.

Subsequently, as shown in FIG. 11(B), a photomask 104 is superimposed on the resist film 102 whose surface is formed with the microparticle layer. A mask pattern 105 (light shielding area) as shown in FIG. 11(A) is formed on the under surface of the photomask 104. Since there is no need for designing a fine irregularity on the periphery of this mask pattern 105, cost for the mask can be kept low. When the resist film 102 is exposed to light through the photomask 104 as shown in FIG. 11(B), the photomask 104 transmits light and the resist film 102 is exposed to light in an area not provided with the mask pattern 105. Simultaneously, light having transmitted through the photomask 104 is also shielded by the microparticles 103, and hence an irregularity is generated at the edge of the light shielding area of the resist film 102 even when the edge of the mask pattern 105 is smooth as in FIG. 11(A).

Figure 12B:
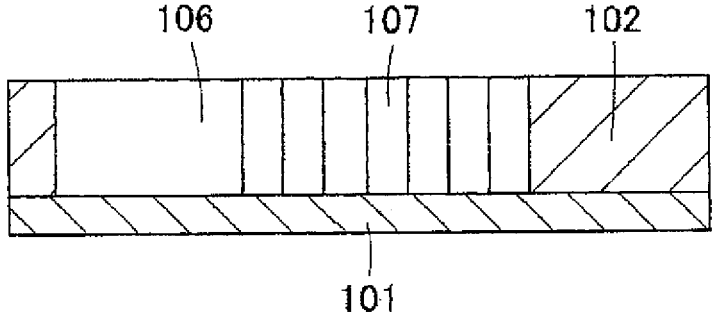

In the case of using the negative type resist, the resist in the exposed area is insolubilized. In FIG. 11(C), the insoluble resist is represented by hatching with solid lines, and the soluble resist is represented by hatching with broken lines. Therefore, when the resist film 102 is developed after removal of the microparticles 103, as shown in FIGS. 12(A) and 12(B), the resist film 102 in the light shielding area is removed while only the resist film 102 in the exposed area is left, to open a cavity 106 inside the resist film 102. At this time, an irregular pattern 107 extending in a vertical direction and having an arc-shaped cross section is formed on the wall surface of the cavity 106 by shades of the microparticles 103.

Figure 12C:
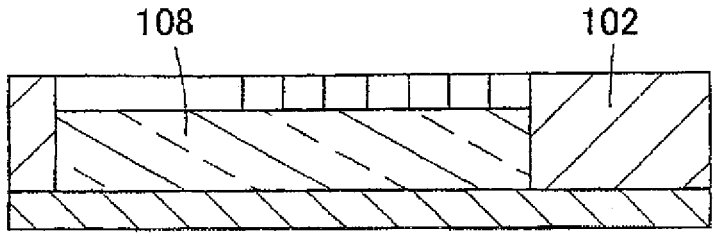
Figure 12:
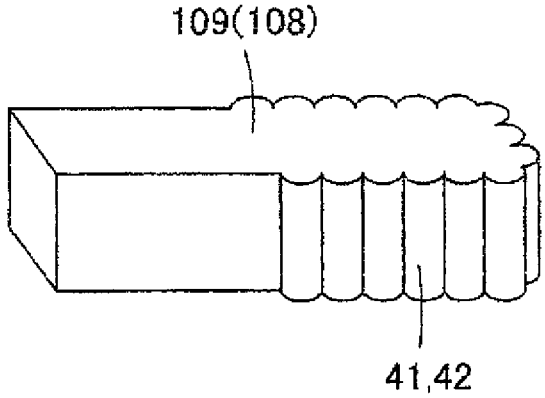

Thereafter, as shown in FIG. 12(C), an electroforming material 108 is grown inside the cavity 106 of the resist film 102 by electroforming, so as to be molded into a predetermined shape. The electroforming material 108 used is one primarily composed of any of N, Co, Fe, Cu, Mn, Sn and Zn, or may be an alloy of these. When an electroforming material 64 is grown to have a sufficient thickness, the electroforming step is completed.

Subsequently, the resist film 102 is removed by means of a separating solution. In such a manner, a metal component 109 as shown in FIG. 12(D) is obtained. This metal component 109 is, for example, a contact, and on the whole or part of an outer periphery thereof, the irregular shapes 41, 42 are formed which continuously extend from the end to the end along a width direction of the metal component 109.

Since molding the metal component 109 and the irregular shapes 41, 42 by electroforming in such a manner enables the use of a mask pattern with a simple shape, manufacturing cost can be made low.

Figure 13:
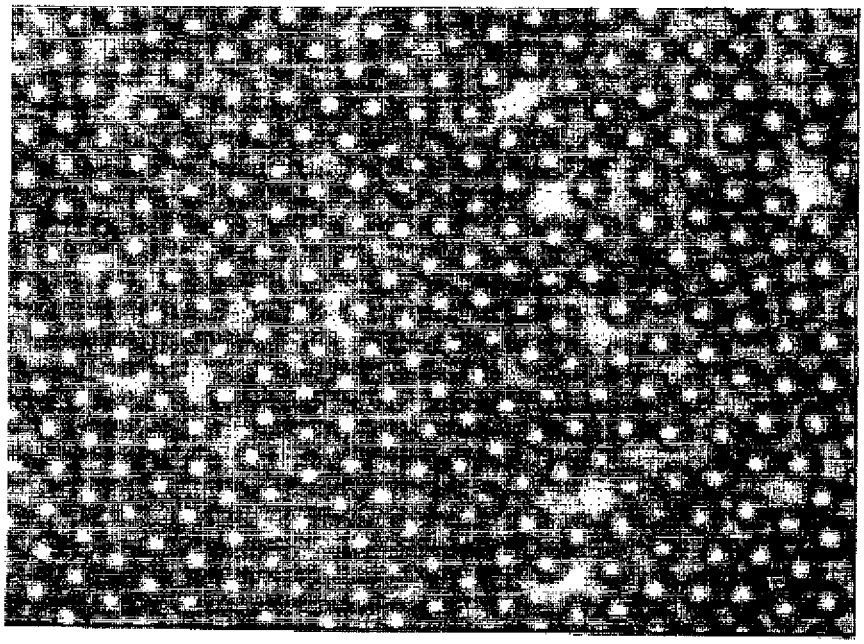
FIG. 13 shows microparticles dispersed on the surface of a resist.
Figure 14:
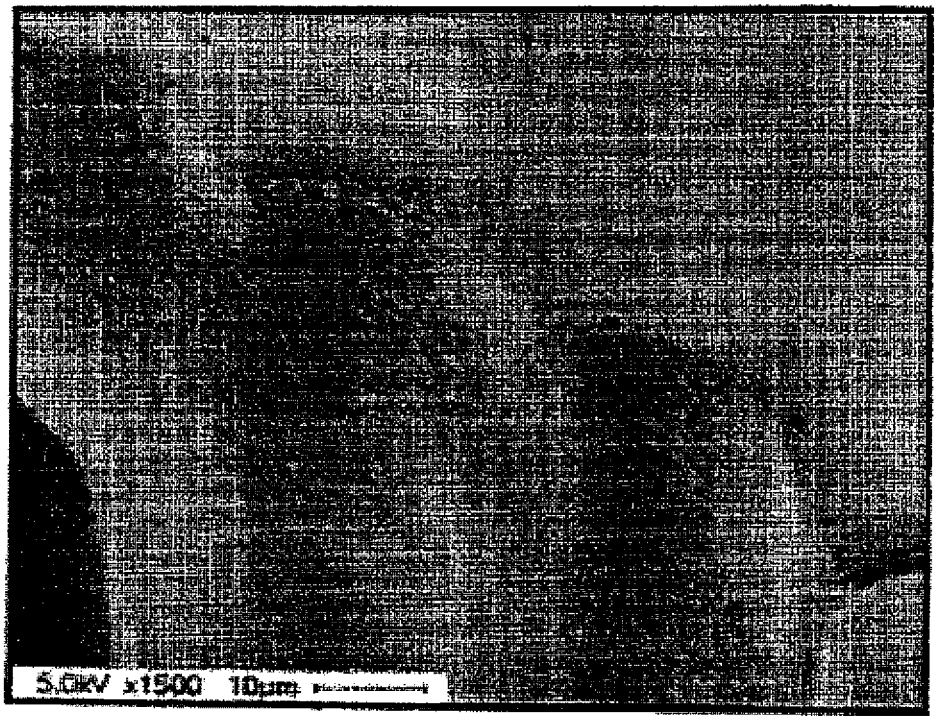
FIG. 14 shows an irregular pattern of a resist formed by the first manufacturing method for the metal component.

FIG. 13 is a micrograph taken of a state where microparticles with a diameter of 28 μm are applied to the surface of a resist film. FIG. 14 is a SEM photograph taken of a negative type resist film subjected to exposure and development through this microparticle layer. It is found that a striped irregular pattern is formed on the wall surface of a cavity.

Figure 15:
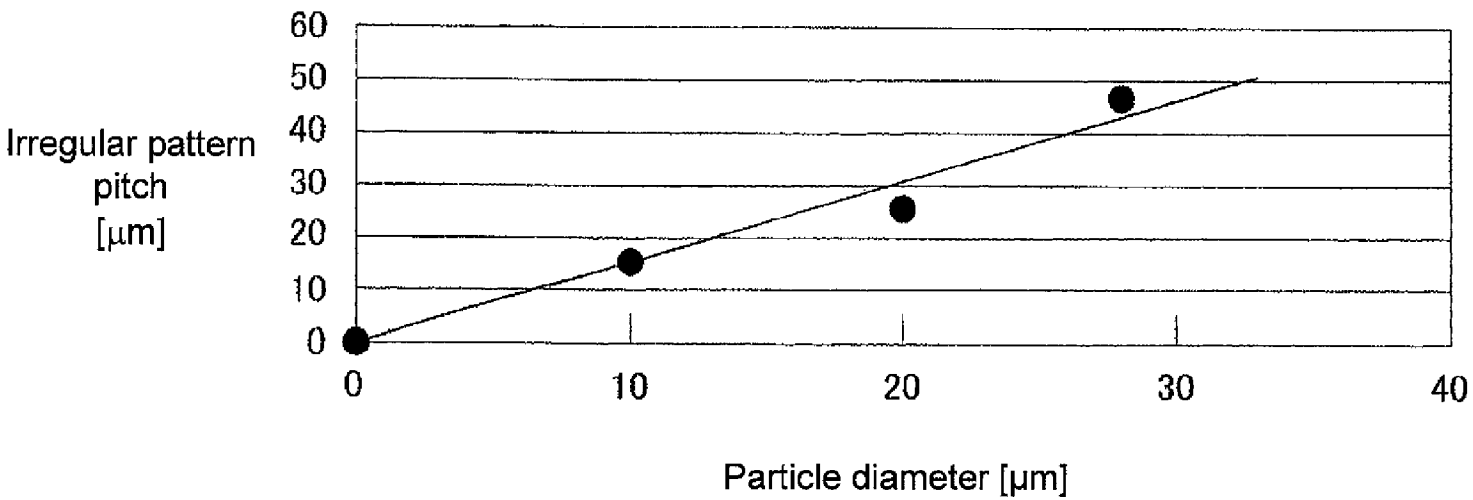
FIG. 15 is a view showing the relationship between a particle diameter of the microparticle and a stripe diameter of the irregular shape formed in the metal component.

FIG. 15 represents a result measured as to how a pitch of the irregular pattern formed on the wall surface of the resist film changes when a particle diameter of the microparticles is changed in the range of 0 to about 30 μm (herein, the particle diameter of 0 μm means the case of nonexistence of the microparticles). According to this result, it is found that the pitch of the irregular pattern and the particle diameter are almost proportional to each other. Hence adjusting the particle diameter can give the irregular shapes 41,42 at almost desired pitches.

(Second Manufacturing Method for Metal Component)

Figure 16A:
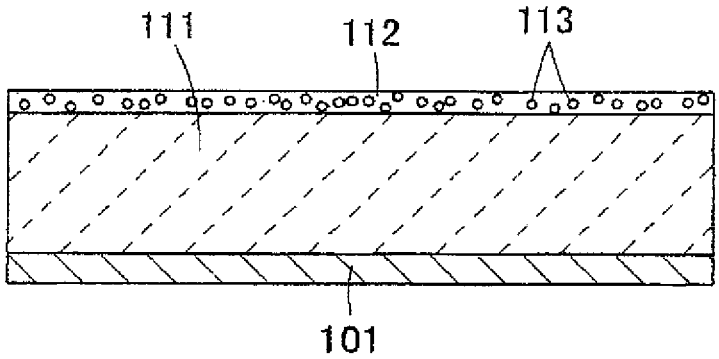
FIGS. 16(A) to 16(C) are schematic views showing a second manufacturing method for manufacturing the metal component having the irregular shape with an arc-shaped cross section.
Figure 16B:
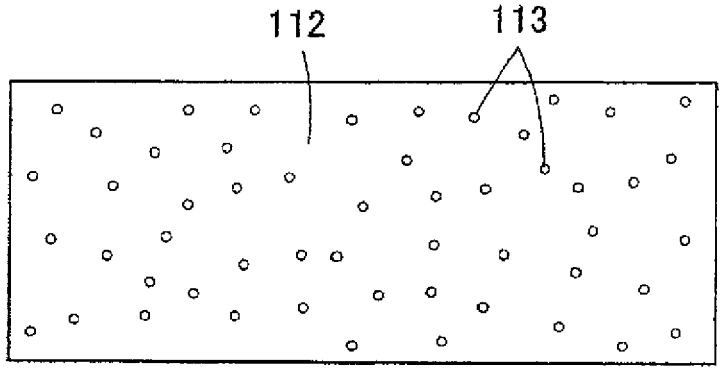
Figure 16C:
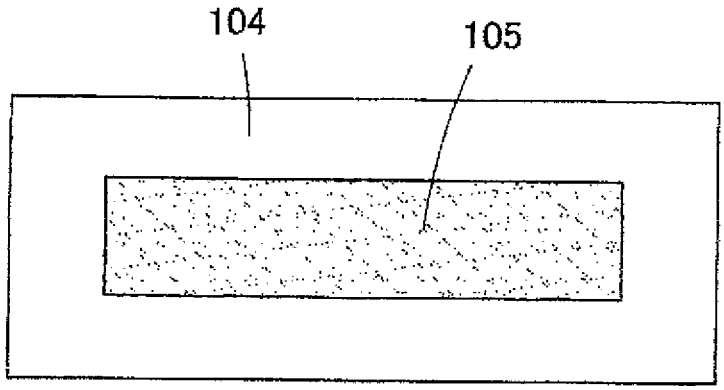
Figure 17A:
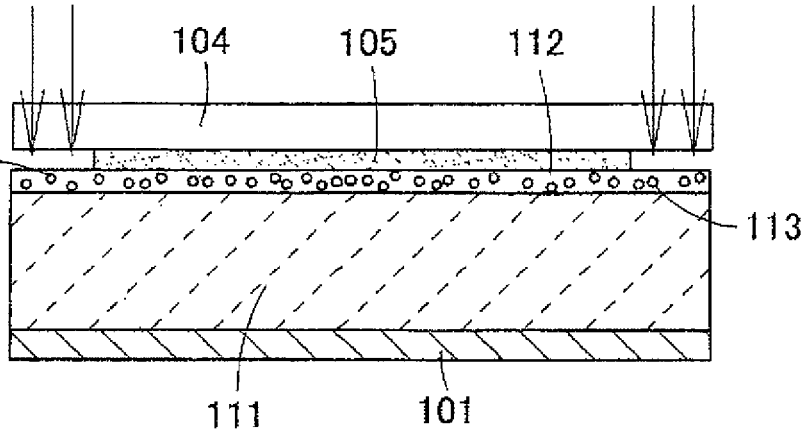
FIGS. 17(A) and 17(B) are schematic views showing the second manufacturing method for manufacturing the metal component having the irregular shape with an arc-shaped cross section, continued from FIG. 16(C).
Figure 17B:
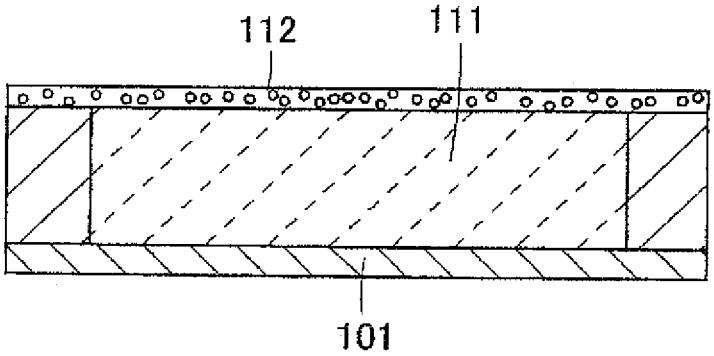
Figure 18A:
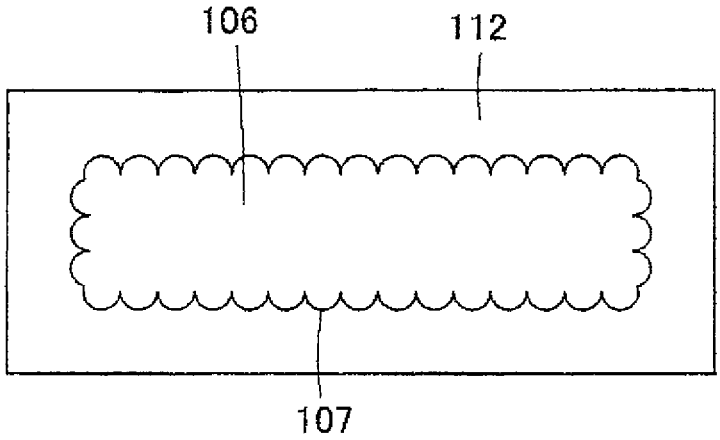
FIGS. 18(A) to 18(C) are schematic views showing the second manufacturing method for manufacturing the metal component having the irregular shape with an arc-shaped cross section, continued from FIG. 17(B).
Figure 18B:
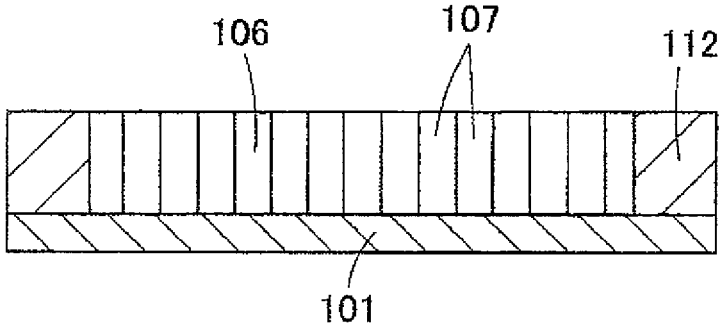
Figure 18C:
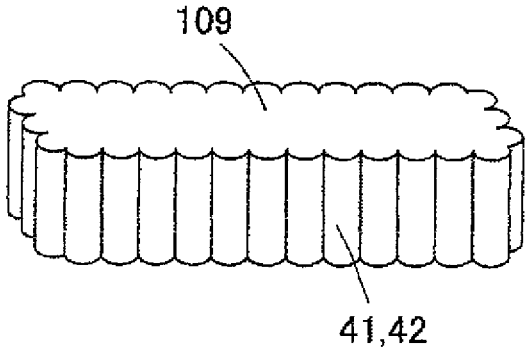

A second manufacturing method for a metal component by electroforming is shown in FIGS. 16(A) to 16(C), FIGS. 17(A), 17(B) and FIGS. 18(A) to 18(C). Herein, FIGS. 16(A), 17(A), 17(B) and 18(B) are sectional views. FIG. 16(B) is a plan view of FIG. 16(A). FIG. 16(C) is a bottom view of a photomask shown in FIG. 17(A). FIG. 18(A) is a plan view of FIG. 18(B). FIG. 18(C) is a perspective view of the metal plate.

A dry film resist is used in the second manufacturing method. Generally, a dry film resist is pasted onto a base material film, onto which a protective film is further pasted, and the dry film resist is distributed in such a state of a three-layer structure of the base material film, the dry film resist and the protective film. Furthermore, microparticles referred to as a lubricant are mixed into the protective film for preventing intimate contact at the time of roll-winding in a dry film manufacturing step. At the time of use of this dry film resist, the base material film is peeled off and the resist is pasted to a base material such as an electrode plate, and then used.

In the second manufacturing method according to one or more embodiments of the present invention, first, as shown in FIGS. 16(A) and 16(B), a dry film resist 111 from which the base material film has been peeled off is brought into intimate contact with the top surface of the electrode plate 101 for electroforming and then pasted thereto. Therefore, when the dry film resist 111 is provided on the top surface of the electrode plate 101, thereon, a lubricant 113 (microparticles) is distributed in a transparent protective film 112.

Thereafter, as shown in FIG. 17(A), the photomask 104 is superimposed on a protective film 112. The mask pattern 105

(light shielding area) as shown in FIG. 16(C) is formed on the under surface of the photomask 104. When the dry film resist 111 is exposed to light through the photomask 104 and the protective film 112 as in FIG. 17(A), light is shielded by the lubricant 113, and thereby, an irregularity is generated at the edge of the light shielding area of the protective film 112 even when the edge of the mask pattern 105 is smooth as in FIG. 16(C).

In the case of a negative type protective film 112 being in use, the resist in the exposed area is insolubilized as in FIG. 17(B). Therefore, when the resist film 102 is developed after peeling-off of the protective film 112, as shown in FIGS. 18(A) and 18(B), 112 in the light shielding area is removed while only the protective film 112 in the exposed area is left, to open the cavity 106 inside the protective film 112. At this time, the irregular pattern 107 extending in a vertical direction and having an arc-shaped cross section is formed on the wall surface of the cavity 106 by shades of 113.

Thereafter, when an electroforming material is deposited and grown inside the cavity 106 by electroforming to have a predetermined thickness (width), the metal component 109 as shown in FIG. 18(C) is manufactured.

Since a mask pattern with a simple shape can also be used in electroforming in such a manner, manufacturing cost can be made low.

Figure 19:
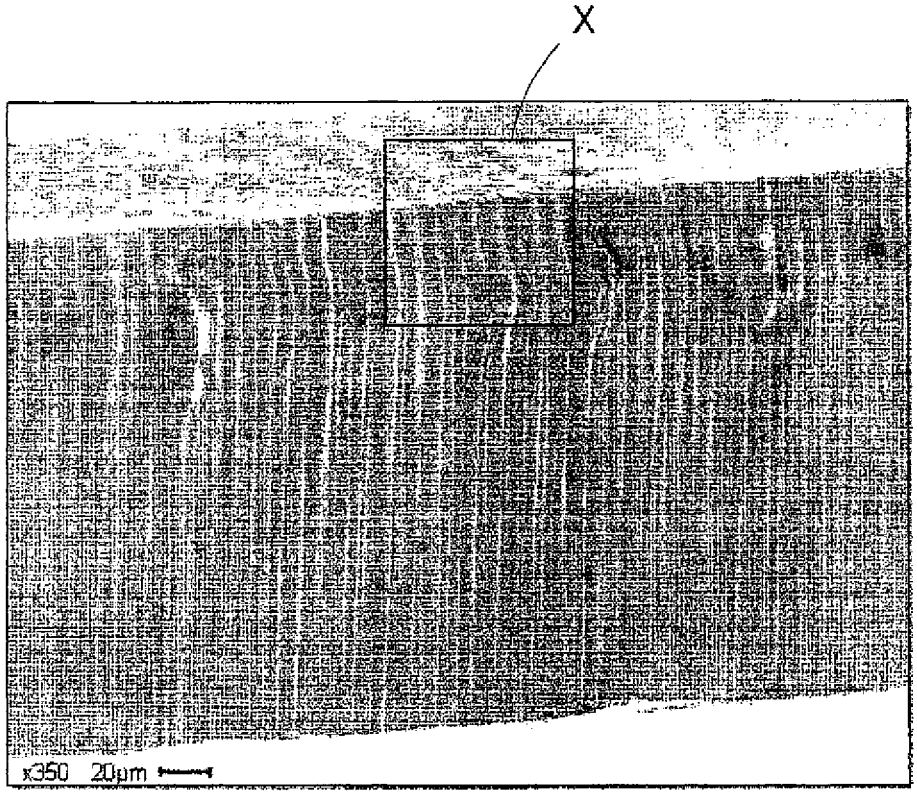
FIG. 19 shows an irregular pattern formed by the second manufacturing method for the metal component.
Figure 20:
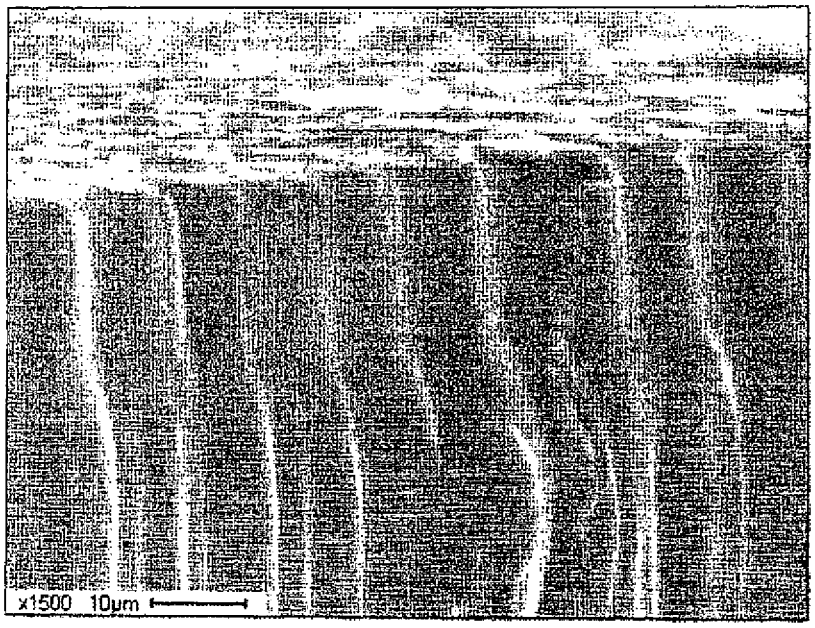
FIG. 20 shows an enlarged manner of an X section of FIG. 19.

FIG. 19 is a SEM photograph taken of the end surface of the metal component manufactured by the second manufacturing method. Further, FIG. 20 is an enlarged photograph of an X section of FIG. 19. This is a metal component manufactured by performing exposure and development while leaving the protective film on the dry film resist, and performing electroforming, and shows an irregular shape generated by the lubricant of the protective film.

(Third Manufacturing Method for Metal Component)

Figure 21A:
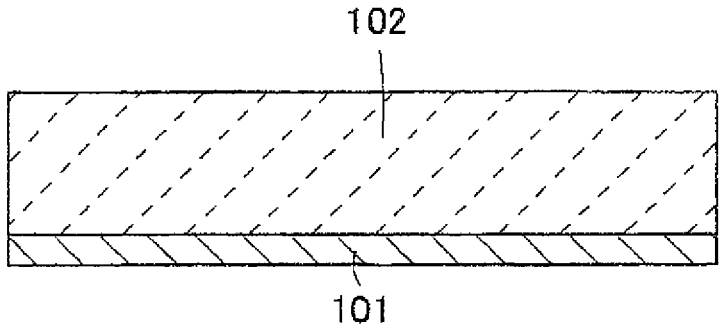
FIGS. 21(A) to 21(C) are schematic views showing a third manufacturing method for manufacturing the metal component having the irregular shape with an arc-shaped cross section.
Figure 21B:
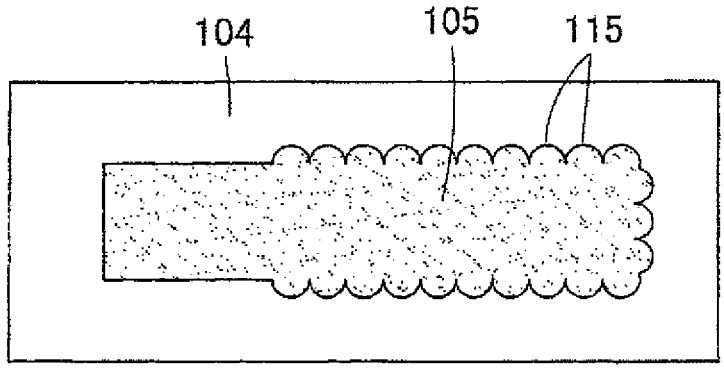
Figure 21C:
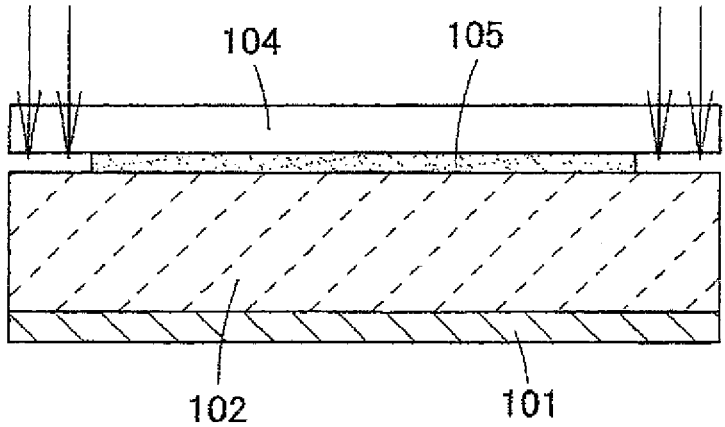
Figure 22A:
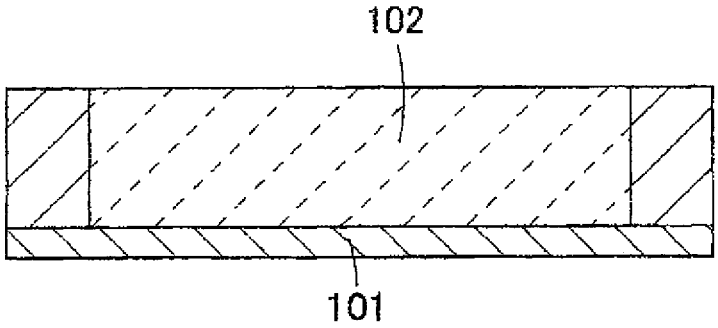
FIGS. 22(A) to 22(D) are schematic views showing the third manufacturing method for manufacturing the metal component having the irregular shape with an arc-shaped cross section, continued from FIG. 21(C).
Figure 22B:
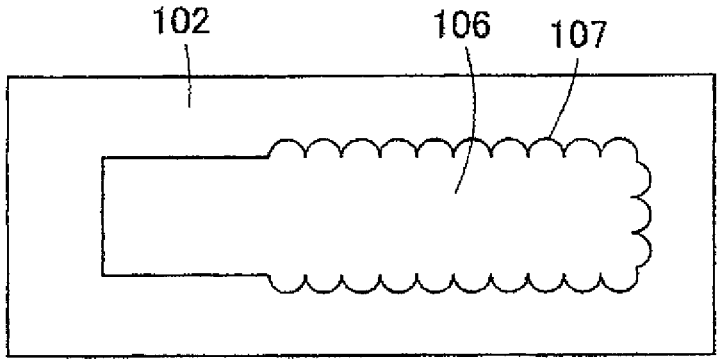
Figure 22C:
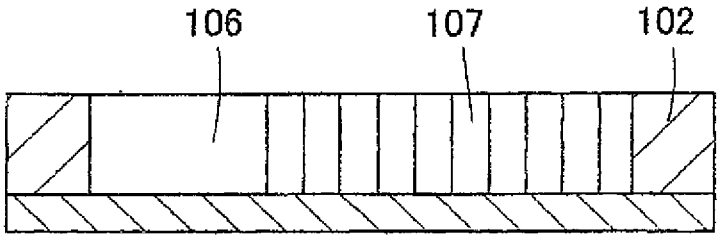
Figure 22D:
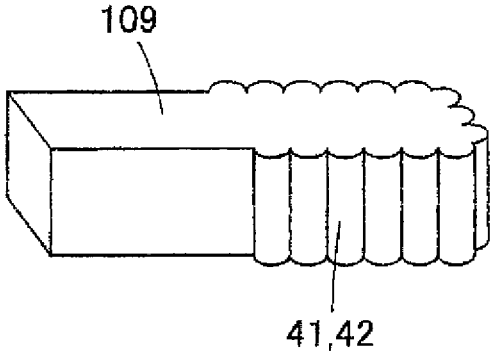

A third manufacturing method for a metal component by electroforming is shown in FIGS. 21(A) to 21(C) and FIGS. 22(A) to 22(D). Herein, FIGS. 21(A), 21(C), 22(A) and 22(C) are sectional views. FIG. 21(B) is a bottom view of a photomask shown in FIG. 21(C). FIG. 22(B) is a plan view of FIG. 22(C). FIG. 22(D) is a perspective view of the metal plate.

In the third manufacturing method, first, as shown in FIG. 21(A), a negative type resist is applied to the top surface of the electrode plate 101 for electroforming, to form the resist film 102. Subsequently, as shown in FIG. 21(C), the photomask 104 is superimposed on the resist film 102. The mask pattern 105 (light shielding area) as shown in FIG. 21(B) is formed on the under surface of the photomask 104. A fine irregularity 115 is designed in part or the whole of an outer periphery of this mask pattern 105. It is to be noted that, although the irregularity 115 is overdrawn in FIG. 21(B), the irregularity 115 is a fine pattern even compared with the size of the mask pattern 105. When the resist film 102 is exposed to light through the photomask 104 as shown in FIG. 21(C), the photomask 104 transmits light and the resist film 102 is exposed to light in an area not provided with the mask pattern 105

In the case of using the negative type resist, the resist in the exposed area is insolubilized as in FIG. 22(A). Therefore, when the resist film 102 is developed, as shown in FIGS. 22(B) and 22(C), the resist film 102 in the light shielding area is removed while only the resist film 102 in the exposed area is left, to open the cavity 106 inside the resist film 102. At this time, the irregular pattern 107 extending in a vertical direction and having an arc-shaped cross section is formed on the wall surface of the cavity 106 by the irregularity 115 of the mask pattern 105.

Thereafter, an electroforming material is grown inside the cavity 106 of the resist film 102 by electroforming, to manufacture the metal component 109 in a predetermined shape. This metal component 109 is, for example, a contact, and on the whole or part of an outer periphery thereof, irregular shapes 41, 42 are provided which continuously extend from the end to the end along a width direction of the metal component 109.

Since molding the metal component 109 and the irregular shapes 41, 42 by electroforming in such a manner enables the use of a mask pattern with a simple shape, manufacturing cost can be made low.

According to such a manufacturing method, it is possible to form the irregular shapes 41, 42 in an arbitrary shape.

(Second Connector)

Figure 23:
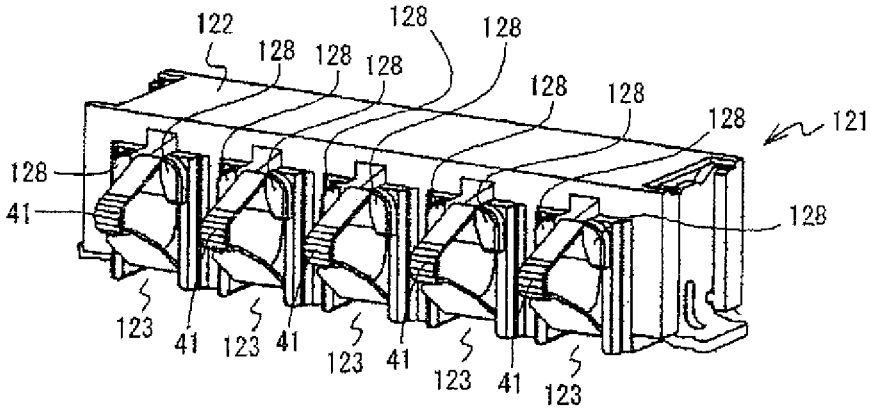
FIG. 23 is an external perspective view showing another connector according to one or more embodiments of the present invention.

Next, a contact and a connector of another embodiment of the present invention are described. This connector 121 is a connector which is brought into contact with an electrode pad of a battery to be used for portable electronic equipment so as to perform charging. FIG. 23 is a perspective view showing the connector 121, and FIG. 24 is a sectional view of the connector.

As shown in FIG. 23, this connector 121 is one formed by housing a plurality of contacts 123 inside a connector housing 122, and part of the contact 123 is projected from the front surface of the connector housing 122.

Figure 24:
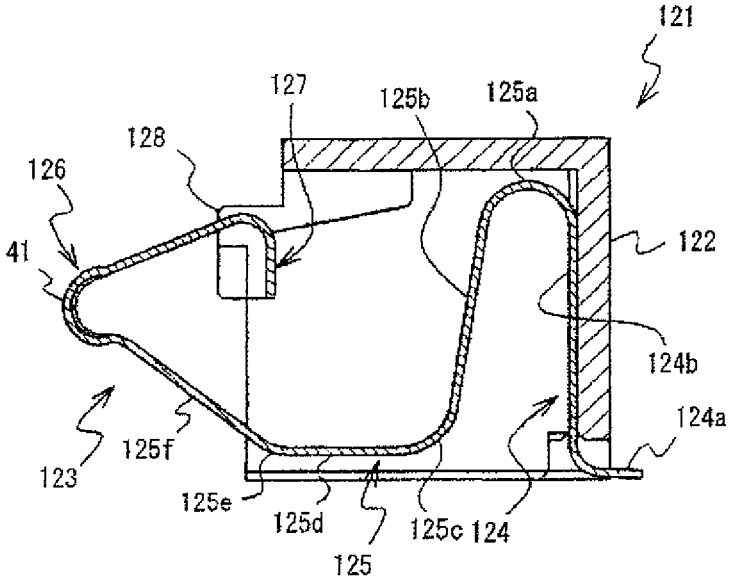
FIG. 24 is a sectional view of the connector of FIG. 23.

As shown in FIG. 24, the contacts 123 is configured of a fixing section 124, an elastic section 125, a contact section 126 and a latch section 127. The fixing section 124 of the contacts 123 is provided with a contact tail 124*a* extending in a horizontal direction at the rear end, and a holding section 124*b* bent vertically upward from the contact tail 124*a* and extending upward. The contact tail 124*a* is electrically connected to the printed wiring board mounted with the connector 121. Further, the contact 123 is fixed to the connector housing 122 by the contact tail 124*a*.

The elastic section 125 of the contact 123 is provided with a first curved section 125*a* curved in a U shape from the upper end of the fixing section 124, a first connecting section 125*b* extending from the first curved section 125*a* downward, a second curved section 125*c* curved from the lower end of the first connecting section 125*b* toward horizontal and forward directions, a second connecting section 125*d* extending from the front end of the second curved section 125*c* toward horizontal and forward directions, a third curved section 125*e* curved obliquely upward from the front end of the second contacting section 125*d*, and an extended section 125*f* extending obliquely forward and upward from the front end of the third curved section 125*e*. With the above configuration, the elastic section 125 forms a substantially S shape, and the contacts 123 can generate sufficient bias force in a longitudinal direction.

The contact section 126 of the contacts 123 is curved backward from the front end of the extended section 125*f* of the elastic section 125 while forming a substantially U shape or an arc shape, and this curved surface forms a contact section 23*a*. In this contact section 126, as shown in FIG. 23, the irregular shape 41, made up of protrusions having an arc-shaped cross section continued from one end to the other end along a width direction, are formed in parallel with one another. In addition, a width of the vicinity of the contact section 23*a* of the contact section 126 is smaller than those of the other portions.

The latch section 127 of the contacts 123 is formed by further folding back downward the end of the contact section 126, and this latch section 127 is latched to a contact support section 128 provided in the opening of the connector housing 122.

Figure 25:
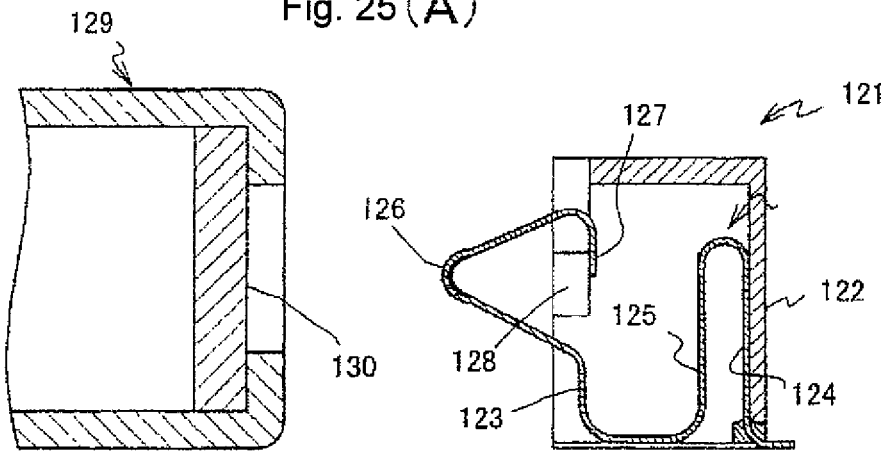
FIG. 25 is a view showing a state of contact between the connector of FIG. 23 and a battery, where
Figure 25:
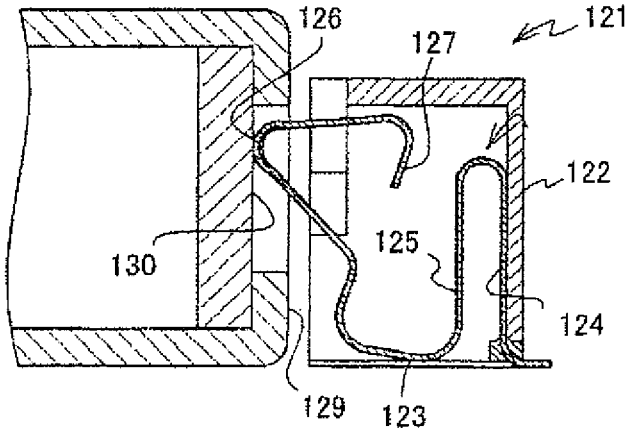

This connector 121 is one in contact with a portable battery 129 as shown in FIGS. 25(A) and 25(B). That is, when the battery 129 is pressed to the connector 121, the contact section 126 provided with the irregular shape 41 comes into contact with an electrode 130 of the battery 129 and is then bent, and a current for charging is supplied from the connector 121 to the battery 129.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

| | |
|---|---|
| 31 | contact |
| 32 | fixing piece |
| 33 | movable piece |
| 34 | connecting section |
| 35 | movable contact point section |
| 35a | contact-point contact surface |
| 37 | fitting section |
| 37a | pressure-contact surface |
| 41 | irregular shape |
| 42 | irregular shape |
| 46 | flexible print board |
| 51 | connector |
| 101 | electrode plate |
| 102 | resist film |
| 103 | microparticle |

-continued

DESCRIPTION OF SYMBOLS

| | |
|---|---|
| 104 | photomask |
| 111 | dry film resist |
| 112 | protective film |
| 113 | lubricant |

The invention claimed is:

1. A contact comprising:

a contact section with an other member; and an irregular shape including at least either a depression or a protrusion provided in the contact section with the other member, wherein the irregular shape is provided at a time of production by electroforming, wherein a width of the contact is at most 250 μm, and wherein the irregular shape has an arc-shaped surface or a semicircular cross-section.

2. The contact according to claim 1, wherein the contact section with the other member is a contact point section, and the irregular shape extends in a vertical direction to a pressing direction and a wiping direction in the contact point section.

3. The contact according to claim 1, wherein the contact section with the other member is a pressure-contact section to the other member, and the irregular shape extends in a vertical direction to an inserting direction into the other member.

4. The contact according to claim 1, wherein a tip of the protrusion constituting the irregular shape is curved.

5. The contact according to claim 1, wherein the protrusion or the depression constituting the irregular shape is continued from one end to the other end in a width direction.

6. A connector, wherein the contact according to claim 1 is housed inside a housing.

* * * * *